US009274455B2

(12) United States Patent
Miura et al.

(10) Patent No.: US 9,274,455 B2
(45) Date of Patent: Mar. 1, 2016

(54) IMAGE FORMING APPARATUS SUPPLYING TONER FROM CONTAINER TO ACCUMULATING UNIT BASED ON TOWER DENSITY DEVELOPER IN THE ACCUMULATING UNIT, AND METHOD OF CONTROLLING IMAGE FORMING APPARATUS

(71) Applicant: CANON KABUSHIKI KAISHA, Tokyo (JP)

(72) Inventors: Shusuke Miura, Toride (JP); Jiro Shirakata, Chigasaki (JP); Takayuki Iikura, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/565,101

(22) Filed: Dec. 9, 2014

(65) Prior Publication Data

US 2015/0168904 A1 Jun. 18, 2015

(30) Foreign Application Priority Data

Dec. 17, 2013 (JP) ..... 2013-260381

(51) Int. Cl.
*G03G 15/08* (2006.01)

(52) U.S. Cl.
CPC ..... *G03G 15/0879* (2013.01); *G03G 15/0849* (2013.01); *G03G 2215/0132* (2013.01)

(58) Field of Classification Search
CPC ..... G03G 15/556; G03G 15/0889; G03G 15/0877; G03G 15/0879
See application file for complete search history.

(56) References Cited

U.S. PATENT DOCUMENTS

| | | | | |
|---|---|---|---|---|
| 7,603,065 | B2 * | 10/2009 | Yamaguchi et al. | 399/258 |
| 2011/0020017 | A1 * | 1/2011 | Takahashi | 399/30 |
| 2013/0202319 | A1 * | 8/2013 | Komatsu et al. | 399/27 |

FOREIGN PATENT DOCUMENTS

JP 2013-160969 A 8/2013

* cited by examiner

*Primary Examiner* — Rodney Bonnette
(74) *Attorney, Agent, or Firm* — Canon USA, Inc. IP Division

(57) ABSTRACT

An image forming apparatus including a replaceable container having toner stored therein includes: an image forming unit including an accumulating unit for accumulating developer containing toner and configured to form an image by using the developer in the accumulating unit; a measurement unit configured to measure a toner density in the accumulating unit; a portion to which the container is attached; a supplementing unit configured to supplement the toner from the attached container to the accumulating unit; and a controller configured to control the supplementing unit based on first information corresponding to a difference between the toner density and a target toner density and second information corresponding to an accumulated value obtained by accumulating differences, wherein the second information does not change in a period from replacement of the container by another container until a predetermined number of times of supplement is performed.

18 Claims, 6 Drawing Sheets

IMAGE FORMING APPARATUS SUPPLYING TONER FROM CONTAINER TO ACCUMULATING UNIT BASED ON TOWER DENSITY DEVELOPER IN THE ACCUMULATING UNIT, AND METHOD OF CONTROLLING IMAGE FORMING APPARATUS

BACKGROUND OF THE INVENTION

1. Field of the Invention

The present invention relates to a supplement control for supplementing toner from a container to an accumulating unit.

2. Description of the Related Art

An image forming apparatus of an electrophotographic system forms a toner image based on an image data input to the image forming apparatus by consuming the toner stored in an accumulating unit. A configuration of the image forming apparatus in which the toner stored in the accumulating unit is consumed by forming toner images, and hence the toner is supplemented as needed to the accumulating unit from a container configured to be detachably attachable with respect to the image forming apparatus is known.

In the image forming apparatus, the fact that a concentration of a toner image developed by the accumulating unit is changed in accordance with an amount of toner accumulated in the accumulating unit is known. Accordingly, the image forming apparatus is required to supplement the toner from the container to the accumulating unit so that the amount of toner stored in the accumulating unit reaches a target amount.

In the image forming apparatus of the related art, a configuration in which a toner supplement amount is determined based on a difference between an amount of toner to be consumed from the accumulating unit by forming the toner image (amount of consumption) and a difference between the amount of toner and the target amount to be accumulated in the accumulating unit is known. For example, an image forming apparatus described in Japanese Patent Laid-Open No. 2013-160969 determines the toner supplement amount based on the amount of consumption estimated based on the image data, the difference between the amount of toner and the target amount to be accumulated in the accumulating unit, and an accumulated total value of the differences.

Here, the amount of consumption of toner is a theoretical amount based on calculation, and hence there is a slight difference between the actual amount of consumption of the toner consumed actually from the accumulating unit and the estimated amount of consumption described above. Accordingly, even though toner of an amount corresponding to the estimated amount of consumption described above is supplemented to the accumulating unit, the amount of toner in the accumulating unit may not become the target amount. Therefore, the image forming apparatus described in Japanese Patent Laid-Open No. 2013-160969 is configured to determine the toner supplement amount based on not only the estimated amount of consumption described above, but also the difference between the amount of toner and the target amount to be accumulated in the accumulating unit.

However, in the image forming apparatus described in Japanese Patent Laid-Open No. 2013-160969, there is a probability that the toner is excessively supplemented from the container to the accumulating unit or the amount of toner in the accumulating unit is remarkably reduced from the target value in the case where the container is replaced. This is because the toner supplement amount of the container after replacement is determined based on the accumulated total value suitable for the toner supplement amount of the container which has been mounted on the image forming apparatus before the replacement even though the container has replaced.

SUMMARY OF THE INVENTION

There is provided an apparatus including a replaceable container having toner stored therein, including: an image forming unit including an accumulating unit for accumulating developer containing toner and configured to form an image by using the toner in the accumulating unit based on an image data; a measurement unit configured to measure a toner density of the developer in the accumulating unit; a portion to which the container is attached; a detection unit configured to detect whether or not the container is replaced; a supplementing unit configured to supplement the toner from the container which is attached to the portion to the accumulating unit; a first determination unit configured to determine first information corresponding to a difference between the toner density and a target toner density of the developer in the accumulating unit; a second determination unit configured to determine second information corresponding to an accumulated value obtained by accumulating differences; and a controller configured to control the supplementing unit based on the first information and the second information, wherein the second information changes in a period from detection that the container is replaced by another container by the detection unit until the supplementing unit performs a predetermined times of supplement from another container to the accumulating unit.

There is also provided a method of controlling an image forming apparatus including: an image forming unit including an accumulating unit for accumulating developer containing toner and configured to form an image by using the toner in the accumulating unit; a measurement unit configured to measure a toner density of the developer in the accumulating unit; a portion for mounting a container having toner to be supplemented to the accumulating unit stored therein; and a supplementing unit configured to supplement the toner from the container to the accumulating unit, the method, including: determining first information corresponding to a difference between the toner density and a target toner density of the developer in the accumulating unit; determining second information corresponding to an accumulated value obtained by accumulating the differences; and controlling the supplementing unit based on the first information and the second information, wherein the second information does not change in a period from replacement of the container by another container until the supplementing unit performs a predetermined times of supplement from another container to the accumulating unit.

Further features of the present invention will become apparent from the following description of exemplary embodiments with reference to the attached drawings.

DESCRIPTION OF THE EMBODIMENTS

First Embodiment

Figure 1:
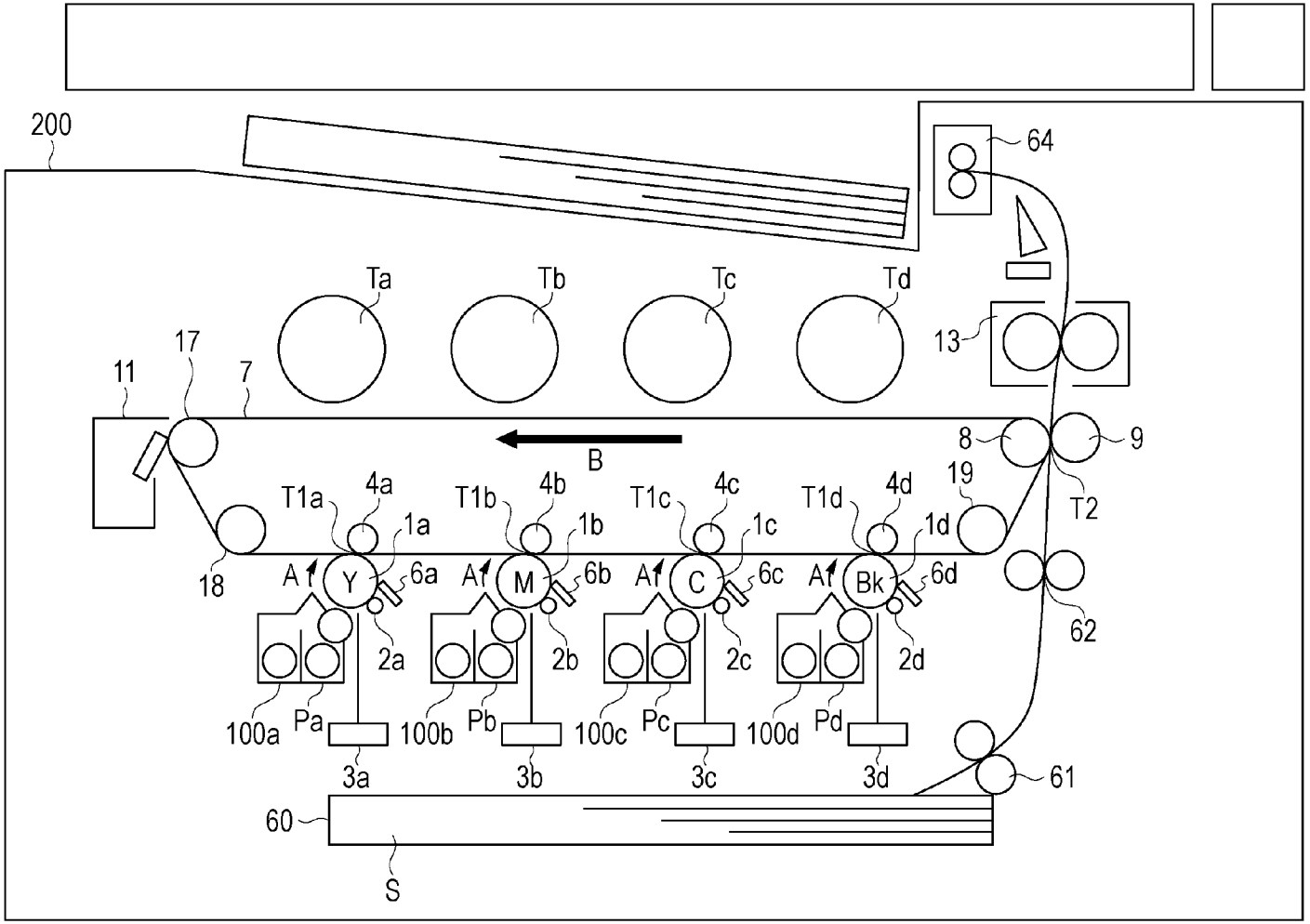
FIG. 1 is a schematic configuration drawing of an image forming apparatus.

FIG. 1 is a schematic cross-sectional view of an image forming apparatus 200. The image forming apparatus 200 includes four image forming portions Pa, Pb, Pc and Pd configured to form toner images of having respective color components and arranged in a line in a direction of conveyance of an intermediate transfer belt 7. The image forming portion Pa forms a yellow toner image, the image forming portion Pb forms a magenta toner image, the image forming portion Pc forms a cyan toner image, and the image forming portion Pd forms a black toner image.

Toner bottles Ta, Tb, Tc, and Td which are demountably mountable on the image forming apparatus 200 are mounted on the image forming apparatus 200. The toner bottle Ta includes yellow toner stored therein, the toner bottle Tb includes magenta toner stored therein, the toner bottle Tc includes cyan toner stored therein, and the toner bottle Td includes black toner stored therein. The toner bottles Ta, Tb, Tc, and Td correspond to a container for storing supplemental toner.

The image forming portions Pa, Pb, Pc and Pd have the same configuration, and hence the image forming portion Pa, Pb, Pc and Pd are referred to collectively as an image forming portion P in the following description. The toner bottles Ta, Tb, Tc, and Td have the same configuration, and hence the toner bottles Ta, Tb, Tc, and Td are referred to collectively as a toner bottle T.

The image forming portion P includes a photosensitive drum 1 provided with a photosensitive layer functioning as a photo sensitive member on a surface of a column-shaped metallic roller, a charger 2 configured to charge the photosensitive drum 1, and a developing unit 100 including toner stored therein. The developing unit 100 is an accumulating unit in which developer including toner is accumulated.

When the image forming action is started, the photosensitive drum 1 is driven to rotate in a direction indicated by an arrow A. After the charger 2 has charged the photosensitive drum 1 uniformly, a laser exposing device 3 exposes the photosensitive drum 1 based on image data. Accordingly, an electrostatic latent image is formed on the photosensitive drum 1. Then, the developing unit 100 develops the electrostatic latent image on the photosensitive drum 1 by using toner, and a toner image is formed on the photosensitive drum 1.

In this embodiment, two-component developer is accumulated in the developing unit 100, and supplemental toner is stored in the toner bottle T. The supplemental toner is supplemented from the toner bottle T to the developing unit 100 so that the amount of toner in the developing unit 100 becomes a target amount. The two-component developer is a developer composed of carrier and toner having magnetism.

Figure 2:
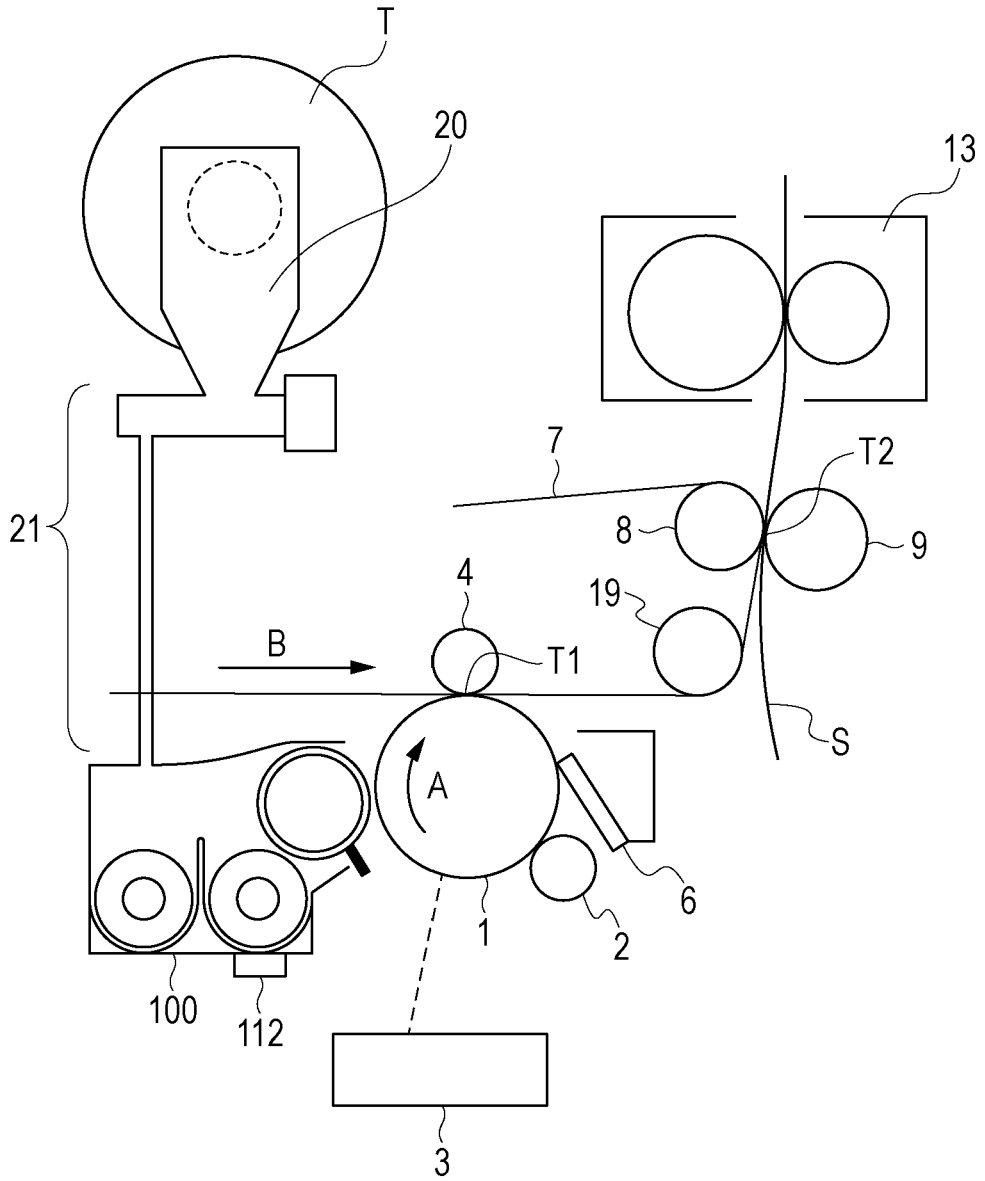
FIG. 2 is a schematic configuration drawing of a principal portion of the image forming apparatus.
Figure 3:
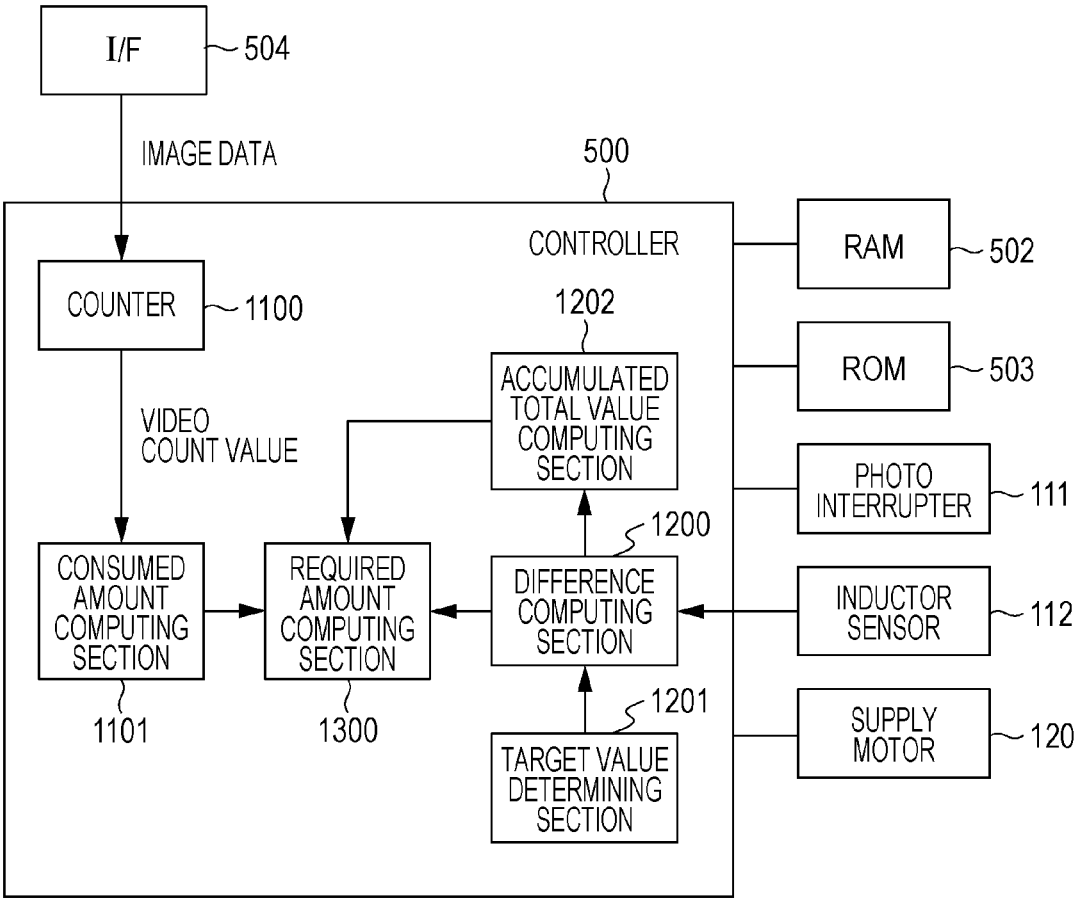
FIG. 3 is a block diagram illustrating an electric configuration of the image forming apparatus relating to toner supplement.

As illustrated in FIG. 2, an inductance sensor 112 configured to detect the amount of toner accumulated in the developing unit 100 is arranged in the developing unit 100. The inductance sensor 112 outputs a signal indicating magnetic permeability of the developer stored in the developing unit 100 to a controller 500 described later (FIG. 3). An output signal of the inductance sensor 112 is a signal that varies in accordance with the amount of toner stored in the developing unit 100.

Here, the output signal from the inductance sensor 112 will be described. When the ratio of the toner in the developer (hereinafter, referred to a "developing unit toner concentration") is increased, the ratio of the carrier in the developer is decreased, so that an output value of the inductance sensor 112 is reduced. In contrast, when the developing unit toner concentration is reduced, the ratio of the carrier in the developer increases, and hence the output value of the inductance sensor 112 is increased. The controller 500 (FIG. 3) detects the amount of toner stored in the developing unit 100 based on the output signal of the inductance sensor 112. In other words, the output signal of the inductance sensor 112 is a signal that indicates the amount of toner stored in the developing unit 100.

FIG. 2 is a schematic configuration drawing of a principal portion of the image forming apparatus 200. The image forming apparatus 200 includes an attaching portion 20 having the toner bottle T mounted thereon, and a supply motor 120 (FIG. 3) configured to engage the toner bottle T mounted on the attaching portion 20 and drive to the toner bottle T to rotate. The toner bottle T is provided with a helical guide groove configured to convey toner to the inner peripheral surface thereof. The supply motor 120 rotates the toner bottle T, whereby the toner in the toner bottle T is supplemented from the toner bottle T to the developing unit 100. The toner discharged from a discharge port of the toner bottle T supplemented is supplied to the developing unit 100 via a conveying path 21.

Returning back to FIG. 1, an explanation of the image forming apparatus 200 will be described. The intermediate transfer belt 7 is wound around a secondary-transfer counter roller 8, a driven roller 17, tension rollers 18 and 19. The intermediate transfer belt 7 rotates in a direction indicated by an arrow B by a rotational drive of the secondary-transfer counter roller 8.

The image forming portion P is provided with a primary transfer roller 4 configured to transfer the toner image on the photosensitive drum 1 to the intermediate transfer belt 7. While the toner image formed on the photosensitive drum 1 is passing through a primary transfer nip portion T1 formed by the photosensitive drum 1 and the intermediate transfer belt 7 compressed against the primary transfer roller 4, a primary transfer voltage is applied to the primary transfer roller 4. Accordingly, the toner image on the photosensitive drum 1 is transferred to the intermediate transfer belt 7. The toner images formed on the respective photosensitive drums 1*a*, 1*b*, 1*c* and 1*d* are transferred to the intermediate transfer belt 7 in a superimposed manner, whereby the intermediate transfer belt 7 bears a full color toner image. A drum cleaner 6 removes the toner remaining on the photosensitive drum 1 which is not transferred from the photosensitive drum 1 to the intermediate transfer belt 7 at the primary transfer nip portion T1.

On a side opposite to the intermediate transfer belt 7 with respect to the secondary-transfer counter roller 8, a secondary transfer roller 9 is disposed. When the secondary transfer roller 9 presses against the secondary-transfer counter roller 8 and the intermediate transfer belt 7, a secondary transfer nip portion T2 is formed between the intermediate transfer belt 7 and the secondary transfer roller 9. By the intermediate transfer belt 7 conveyed in the direction indicated by an arrow B, the toner image on the intermediate transfer belt 7 is conveyed to the secondary transfer nip portion T2.

A conveying roller pair 61 and a registration roller pair 62 conveys a recording member S stored in a cassette portion 60 so that timing when the toner image reaches the secondary transfer nip portion T2 and timing when the recording member S reaches the secondary transfer nip portion T2 are matched. With an application of a secondary transfer voltage on the secondary-transfer counter roller 8 while the toner image on the intermediate transfer belt 7 and the recording member S pass through the secondary transfer nip portion T2, the toner image on the intermediate transfer belt 7 is transferred to the recording member S. A bolt cleaner 11 removes toner remaining on the intermediate transfer belt 7 which is not transferred to the recording member S at the secondary transfer nip portion T2.

After the toner image has transferred to the recording member S by the secondary transfer roller 9, the recording member S is conveyed to the fixing unit 13. The fixing unit 13 is provided with a fixing roller having a heater and a pressing roller, and fixes the toner image on the recording member S to the recording member S by heat of the heater and pressures of the fixing roller and the pressing roller. The recording member S having the toner image fixed thereto by the fixing unit 13 is discharged from the image forming apparatus 200 by a sheet-output-roller pair 64.

Subsequently, a toner supplement control process for supplementing toner from the toner bottle T to the developing unit 100 based on an amount of consumption of toner consumed from the developing unit 100 by the image forming unit P when forming a toner image based on the image data and a result of detection of the inductance sensor 112 will be described.

FIG. 3 is a block diagram illustrating an electric configuration of the image forming apparatus 200 relating to toner supplement. In order to facilitate description of an interior of the controller 500, respective functions to be executed by the controller 500 in the toner supplement control process are illustrated by blocks.

A RAM 502 is a system work memory to be used for the toner supplement control process. A ROM 503 includes a control program for controlling the toner supplement control process stored therein. An I/F 504 is an interface that can be connected to a scanner or an external PC, and receives information such as image data. The inductance sensor 112 is described in conjunction with FIG. 2, and hence description will be omitted here.

The photo interrupter 111 is an optical sensor configured to output an ON signal in the case where the toner bottle T is mounted on the mounting portion 20 (FIG. 2), and output an OFF signal when mounting of the toner bottle T to the mounting portion 20 (FIG. 2) is released. The controller 500 detects the fact that a non-mounted state in which the toner bottle T is not mounted on the mounting portion 20 is changed to a mounted state in which the toner bottle T is mounted to the mounting portion 20 in accordance with a change of the output signal from the photo interrupter 111 from the OFF signal to the ON signal. In other words, the controller 500 determines whether or not the toner bottle T is replaced based on the output signal from the photo interrupter 111. Since a configuration of the photo interrupter 111 is a known configuration, detailed description will be omitted.

The counter 1100 counts a summation of concentrations of the respective pixels included in an image for one page (hereinafter, referred to as a video count value) based on the image data input to the controller 500 by the I/F 504. The video count value counted by the counter 1100 corresponds to the amount of consumption of the toner consumed from the developing unit 100 consumed by the image forming unit P forming the toner image of one page of the recording member. Since a method of acquiring the video count value is a known technology, description will be omitted.

In the embodiment, the controller 500 determines the amount of toner in the developing unit 100 detected based on the output signal from the inductance sensor 112 and the amount (required amount) of toner to be supplemented to the developing unit 100 based on the video count value acquired by the counter 1100. The controller 500 drives the supply motor 120 when the accumulated total value of the required amount exceeds a threshold value to supplement the toner from the toner bottle T to the developing unit 100.

Figure 4:
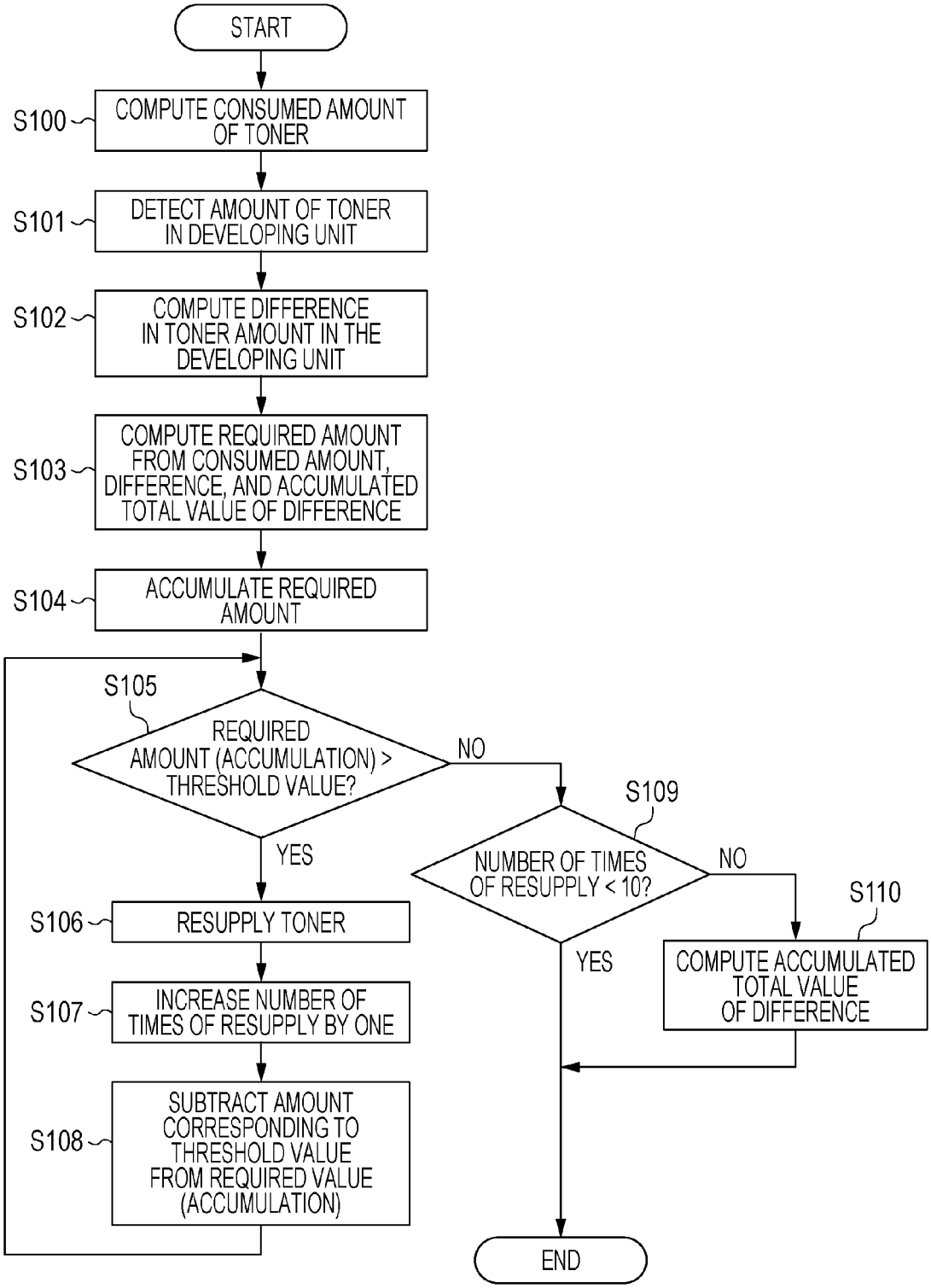
FIG. 4 is a flowchart of toner supplement control.

A toner supplement control in the embodiment will be described with reference to FIG. 4. FIG. 4 is a flowchart of an operation of the controller 500.

The controller 500 starts the toner supplement control by transfer of image data based on an original document generated by a scanner, not illustrated, by reading out the original document, or image data output from a PC, not illustrated, to the controller 500 by the I/F 504. In the case where the image forming portion P forms a plurality of images based on the image data transferred from the I/F 504, the controller 500 executes the toner supplement amount control process every time when an image on one page of the recording member is formed.

The controller 500 computes the amount of toner consumption based on the image data (S100). In Step S100, the counter 1100 counts a video count value Vn based on the image data. A consumed amount computing section 1101 refers a conversion table indicating a correspondence between the video count value and the amount of toner consumption, and determines an amount of toner consumption C based on the video count value Vn counted by the counter 1100. The conversion table is memorized in advance in the ROM 503. In the embodiment, the consumed amount computing section 1101 outputs the amount of consumption C of the toner consumed from the developing unit 100 by the toner image formed on the image forming portion P before the image forming portion P forms the toner image of one page of the recording member.

Before the image forming portion P forms a toner image the amount of consumption C of which is computed by the consumed amount computing section 1101, the controller 500 detects the amount of toner stored in the developing unit 100 based on the output signal from the inductance sensor 112 (S101). Subsequently, a difference computing section 1200 determines the amount of toner in the developing unit 100 based on the output value D from the inductor sensor 112 and computes a difference ΔD between the determined amount of toner and a target value output by a target value determining section 1201 (S102). The target value of the toner stored in the developing unit 100 is a value by predetermined an experiment, and is stored in advance in the ROM 503. In Step S102, the target value determining section 1201 determines the target amount of the toner in the developing unit 100 based on a temperature and a humidity of a periphery of the image forming apparatus 200 detected by an environmental sensor, which is not illustrated, provided on the image forming apparatus 200.

The difference computing section 1200 may be configured to compute a difference between the output value (toner density D) from the inductor sensor 112 and an output target value (target toner density Dref) from the inductor sensor 112. In this case, the target value determining section 1201 determines the output target value of the inductance sensor 112 based on the temperature of the humidity in the periphery of the image forming apparatus 200 detected by an environment sensor, which is not illustrated, provided in the image forming apparatus 200.

The difference computing section 1200 determines a value ΔD corresponding to the difference between the toner density D in the developing unit 100 and the target toner density Dref.

In a case where the amount of toner is smaller than the target value, the difference ΔD is larger than 0, and in a case where the amount of toner is larger than the target value, the difference ΔD is smaller than 0.

After the amount of consumption is computed by the consumed amount computing section 1101, and the difference is computed by the difference computing section 1200, a required amount computing section 1300 computes a required amount X of toner to be supplemented from the toner bottle T to the developing unit 100 based on the amount of consumption C, the difference ΔD, and an accumulated total value ΣΔD described later (S103). In the embodiment, the required amount X is, for example, a control parameter to be computed by using the expression (1).

$$X=(\alpha\times C)+(\beta\times\Delta D)+(\gamma\times\Sigma\Delta D) \quad (1)$$

where, constants α, β, and γ are values of gain determined in advance based on experiment. In the embodiment, for example, the constants β and γ are positive values smaller than 1.

After the required amount X has determined in Step S103, the required amount computing section 1300 computes a required accumulated total value ΣX (S104), and the controller 500 determines whether or not the accumulated total value ΣX is larger than the threshold value (S105). In Step S105, if the accumulated total value ΣX is larger than the threshold value, the controller 500 rotates the toner bottle T by one turn by the supply motor 120, and supplements the toner from the toner bottle T to the developing unit 100 (S106).

In the embodiment, the supply motor 120 drives the toner bottle T to rotate, whereby the toner in the toner bottle T is supplied to the developing unit 100 by a substantially constant amount. Therefore, the controller 500 is capable of determining the amount of rotation of the toner bottle T based on the accumulated total value ΣX of the amount of toner to be supplemented from the toner bottle T to the developing unit 100. In other word, if the accumulated total value ΣX is twice the threshold value or more and smaller than three times, the toner bottle T rotates by two turns, and if the accumulated total value ΣX is three times the threshold value or more and smaller than four times, the toner bottle T rotates by three turns. In the embodiment, the supply motor 120 drives the toner bottle T to rotate in accordance with the amount of rotation determined by the controller 500 while the image forming portion P forms the toner image.

In the embodiment, the minimum amount of rotation of the toner bottle T is assumed to be one turn (360 degrees). Therefore, the toner bottle T does not rotate if the accumulated total value ΣX of the amount of toner to be supplemented from the toner bottle T to the developing unit 100 does not exceed the threshold value.

In the embodiment, the threshold value described above is determined to be a value smaller than the estimated amount of toner to be supplemented from the toner bottle T to the developing unit 100 in the case where the toner bottle T is rotated by one turn (the minimum amount of rotation). The reason is that the difference between the toner concentration and the target value in the developing unit 100 in the case where the toner is not supplemented from the toner bottle T to the developing unit 100 is restrained from becoming larger than the difference between the toner concentration and the target value in the developing unit 100 in the case where the toner is supplemented from the toner bottle T to the toner concentration. The estimated amount of toner to be supplemented from the toner bottle T to the developing unit 100 in the case where the supplementing operation for one dose is executed, that is, in the case where the toner bottle T is rotated by one turn is determined in advance based on experiment.

In the embodiment, the threshold value is determined to be 80% of the amount of toner to be supplemented from the toner bottle T to the developing unit 100 when the toner bottle T is rotated by one turn, for example. The value of this threshold value is memorized in the ROM 503 in advance.

However, depending on the posture and a storage environment of the toner bottle T when the toner bottle T is stored, the amount of toner supplemented actually from the toner bottle T to the developing unit 100 may lose touch from the amount of toner estimated in advance.

Figure 5:
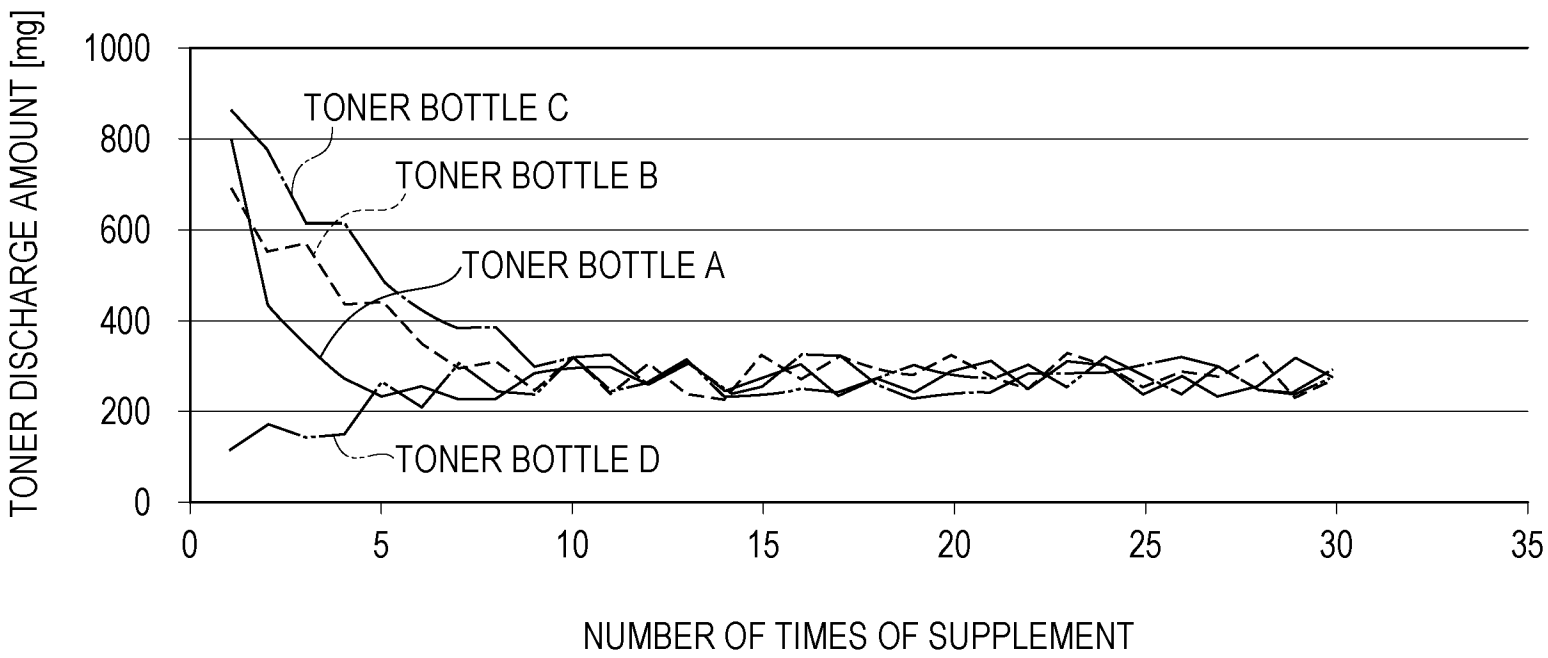
FIG. 5 is a graph showing transitions of a number of times of supplement and an amount of toner discharge by toner bottles.

FIG. 5 is a graph showing changes of the amounts of toner discharged from toner bottles A, B, C, and D when the supply motor 120 rotates the toner bottles A, B, C, and D having different storage conditions are rotated respectively. A vertical axis represents the amount of discharge of the toner discharged from the toner bottle T to the developing unit 100 when the toner bottle T is rotated by one turn, and a lateral axis represents the number of times of rotation of the toner bottle T.

The toner bottles A, B, and C are assumed to be stored in a posture in which an end of a discharge port of the toner bottle is oriented downward in the direction of gravitational force, and the toner bottom D is assumed to be stored in a posture in which an end of a discharge port of the toner bottle is oriented upward in the direction of gravitational force. In addition, the toner bottles A, B, and C are assumed to be stored in storage places different in temperature and humidity from each other.

As illustrated in FIG. 5, when the toner bottles A, B and C is rotated by one turn, the amount of toner (amount of discharge) discharged respectively from the toner bottles A, B and C is larger than the target value (250 mg). In addition, the amounts of discharge of the respective toner bottles A, B and C are gradually decreased as the numbers of times of rotation increases in the case of the toner bottles A, B and C, and when the toner bottles A, B and C rotate more than 10 times, the amounts of discharge are stabilized in the vicinity of the target amounts (250 mg).

As illustrated in FIG. 5, when the toner bottle D is rotated by one turn, the amount of toner discharged from the toner bottle D is smaller than the target value (250 mg). In addition, in the case of the toner bottle D, the amount of discharge of the toner bottle D is gradually decreased as the numbers of times of rotation increases, and when the toner bottle D rotates more than 10 times, the amount of discharge is stabilized in the vicinity of the target amount (250 mg).

The reason why the amount of discharge of the toner discharged from the toner bottle T is not stabilized is that the toner in the toner bottle T is agglutinated while the toner bottle T is stored. When the toner in the toner bottle T is agglutinated in the periphery of the discharge port, the amount of discharge of the toner exceeds the target value immediately after the rotation of the toner bottle T. When the toner in the toner bottle T is agglutinated on a side opposite to the discharge port, the amount of discharge of the toner becomes smaller than the target value immediately after the rotation of the toner bottle T.

In the case where the toner is supplemented from the toner bottle T to the developing unit 100 based on the result of computation of the above-described expression (1) in a state in which the amount of toner supplied from the toner bottle T to the developing unit 100 is not stable, the toner concentration in the developing unit 100 does not converge to the target value quickly. Furthermore, in the case described above, the amount of change in the toner concentration in the developing unit 100 may be increased. Accordingly, this embodiment employs a configuration in which the accumulated total value ΣΔD of the difference is not cumulated after the toner bottle T has been mounted on the mounting portion 20 until the toner bottle T rotates by 10 turns without being demounted from the mounting portion 20.

Returning back to FIG. 4, description of the toner supplement control process of this embodiment will be continued. The controller 500 calculates the number of times of rotation of the toner bottle T after the toner bottle T has replaced. In Step S106, when the supply motor 120 rotates the toner bottle T by one turn, the controller 500 increment the value of a number of times of supplement N which indicates the number of times of rotation of the toner bottle T after the toner bottle T has replaced by one (S107). The controller 500 sets the value of the number of times of supplement N to 0 (reset) in accordance with a change of the output signal from the photo interrupter 111 from ON signal to OFF signal, and increments the value of the number of times of supplement N every time when the toner bottle T rotates by one turn.

Subsequently, the controller 500 subtracts the threshold value from the accumulated total value ΣX of the required amount of toner to be supplemented from the toner bottle T to the developing unit 100 (S108), and then the procedure goes to Step S105. In the process from Step S105 to Step S108, the controller 500 drives the toner bottle T to rotate by the supply motor 120 until the accumulated total value ΣX of the required amount of toner to be supplemented from the toner bottle T to the developing unit 100 does not exceed the threshold value.

In Step S105, if the accumulated total value ΣX of the required amount of toner is not larger than the threshold value, the controller 500 determines whether or not the toner bottle T is rotated 10 times or more after the toner bottle T has been mounted (S109). This is because the amount of toner to be supplemented from the toner bottle T to the developing unit 100 is stabilized when the toner bottle T in the embodiment is rotated by 10 turns after the toner bottle T has been mounted.

If the toner to be supplemented from the toner bottle T to the developing unit 100 is not stabilized, the value of the accumulated total value ΣΔD of differences also varies. If the accumulated total value ΣΔD of differences is updated although the toner to be supplemented from the toner bottle T to the developing unit 100 is not stabilized, the amount of toner in the developing unit 100 may vary significantly with respect to the target value. The embodiment employs a configuration in which if the toner bottle T is not rotated by 10 turns or more after the toner bottle T has been mounted, the difference ΔD computed in Step S102 is not cumulated on the accumulated total value ΣΔD of differences to the current accumulated total value of differences ΣΔD.

In Step S109, if the value of the number of times of supplement N is smaller than 10, the controller 500 does not add the difference ΔD computed by the differential computing section 1200 in Step S102 to the current accumulated total value ΣΔD of differences, and terminates the toner supplement control process. In other words, an accumulated total value computing section 1202 holds the accumulated total value ΣΔD of differences computed in the toner supplement control process of the previous time. Accordingly, the required amount computing section 1300 computes the amount X of the toner to be supplemented from the toner bottle T to the developing unit 100 based on the accumulated total value ΣΔD of differences which is not cumulated with the difference ΔD of the previous time.

In contrast, if the value of the number of times of supplement N is 10 or more in Step S109, the accumulated total value computing section 1202 adds the difference ΔD of this time to the accumulated total value ΣΔD of differences (S110). In the accumulating process in Step S110, the accumulated total value ΣΔD of differences corresponds to the accumulated total value ΣΔD of differences at the time of execution of Step S110. In addition, in the accumulating process in Step S110, the difference ΔD of this time corresponds to the difference ΔD computed by the differential computing section 1200 in Step S102.

An accumulating number of times of rotation of the toner bottle T required until the amount of toner supplied from the toner bottle T to the developing unit 100 is stabilized is different depending on the configuration of the toner bottle T. Therefore, the accumulating number of times of rotation of the toner bottle T required until the amount of toner to be supplemented from the toner bottle T to the developing unit 100 is stabilized may be determined by experiment as needed.

After the accumulated total value computing section 1202 has cumulated the difference ΔD on the current accumulated total value ΣΔD of differences in Step S110, the controller 500 terminates the toner supplement amount control process. Accordingly, when the toner supplement control process for the next time is executed, the accumulated total value ΣΔD of differences updated in Step S110 is used for determining the required amount X of toner to be supplemented.

The embodiment employs a configuration in which the accumulated total value ΣΔD of differences is not added in a period after the toner bottle T has been mounted on the mounting portion 20 until the toner bottle T is rotated by the estimated number of times of rotation which stabilizes the amount of discharge of the toner bottle T at the target amount. Therefore, according to the embodiment, significant variation of the amount of toner in the developing unit 100 with respect to the target amount after the toner bottle T has been replaced until the amount of discharge of the toner from the toner bottle T is stabilized may be restrained.

Comparison of Effects

A result of comparison of the toner concentration in the developing unit 100 in the case where the toner supplement control process of the embodiment and the toner supplement control process of a comparative example are executed will be described with reference to FIG. 6.

Figure 6:
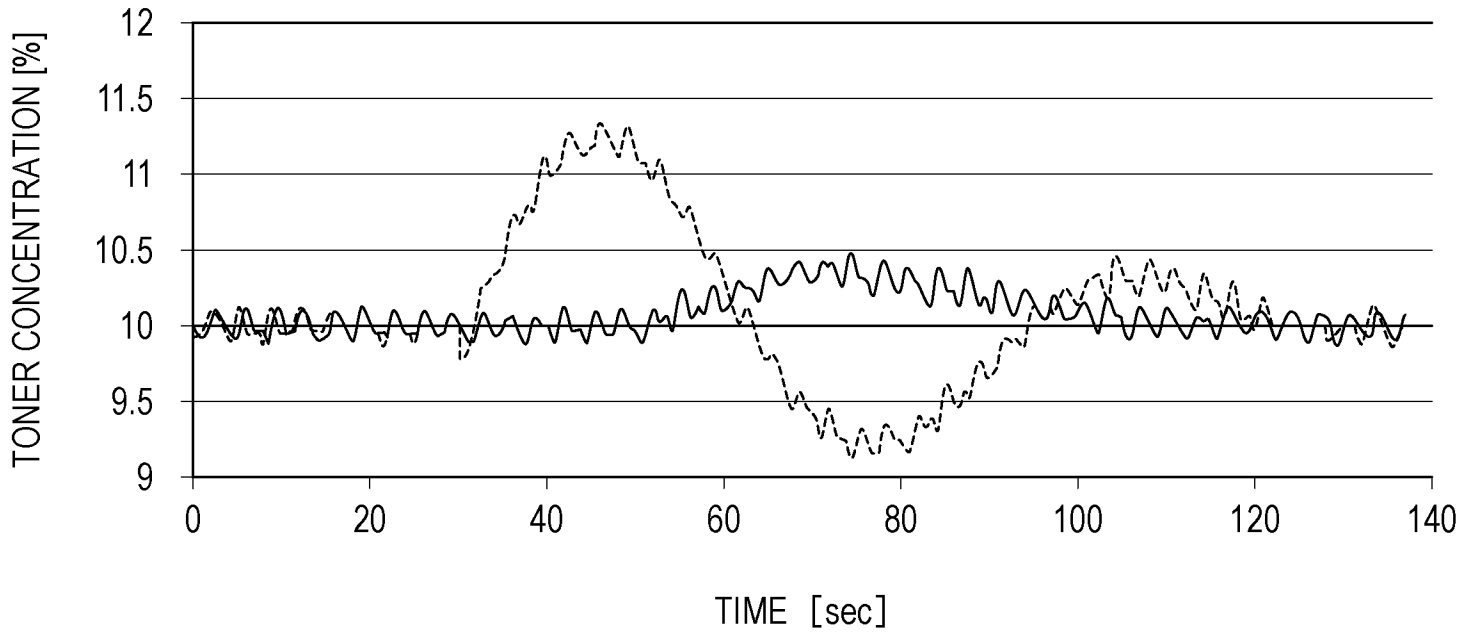
FIG. 6 is a graph showing a transition of an amount of toner stored in a developing unit.

In FIG. 6, the toner concentration in the developing unit 100 in the case where the accumulated total value ΣΔD of differences is not added after the toner bottle T is replaced until the toner bottle T has been rotated by 10 turns or more is indicated by a solid line (the embodiment). Also, the toner concentration in the developing unit 100 in the case where the accumulated total value ΣΔD of differences is added although the toner bottle T has been replaced is indicated by a broken line (comparative example).

FIG. 6 is a drawing illustrating transitions of the toner concentrations in the developing unit 100 in the case where the images having the same video count value were formed continuously after the toner bottle T has been replaced. The target value of the toner concentration in the developing unit 100 was assumed to be 10%. In FIG. 6, the toner concentration when the toner bottle T was replaced was the target value (10%), and the amount of discharge of the toner of the toner bottle T before the replacement was smaller than the target amount (250 mg). In addition, the amount of discharge of the toner of the toner bottle T after the replacement was assumed to be larger than the target amount.

In the comparative example (broken line), the toner was supplemented from the toner bottle T to the developing unit 100 after the elapse of 30 seconds from the replacement of the toner bottle T. Accordingly, the toner concentration in the developing unit 100 was increased. However, since the amount of discharge of the toner from the toner bottle T after the replacement was larger than the target amount, the toner concentration in the developing unit 100 was increased continuously, and exceeds 1.4 points higher than the target value when 40 seconds has elapsed.

This was because a response of the inductance sensor 112 was slow, and hence the accumulated total value ΣΔD make timing of supplement of toner from the toner bottle T to the developing unit 100 earlier although the amount of discharge of toner of the toner bottle T after the replacement is larger than the target amount.

Consequently, after the elapse of 60 seconds after the toner bottle T has been replaced, the toner concentration in the developing unit 100 started to lose touch with the target value toward the minus side. Then, when 75 seconds have been elapsed after the toner bottle T has been replaced, the toner concentration in the developing unit 100 was lower than the target value by 0.8 points.

This was because the accumulated total value ΣΔD of differences was changed to a value which delayed timing of supplement of toner. Accordingly, the toner was not supplemented from the toner bottle T to the developing unit 100 although the toner concentration in the developing unit 100 was lower than the target value.

Then, the toner concentration in the developing unit 100 repeated increase and decrease with respect to the target value, and was stabilized at the target value when approximately 120 seconds have elapsed after the toner bottle T has been replaced.

In contrast, in the embodiment (solid line), toner was supplemented from the toner bottle T to the developing unit 100 after the elapse of 60 seconds from the replacement of the toner bottle T. Accordingly, the toner concentration in the developing unit 100 was increased. When 80 seconds had been elapsed after the toner bottle T has been replaced, the toner concentration in the developing unit 100 was higher than the target value by 0.5 points. In addition, when approximately 100 seconds had elapsed after the toner bottle T has been replaced, the toner concentration in the developing unit 100 was stabilized at the target value.

This was because the accumulated total value ΣΔD of differences before the replacement does not make timing of supplement of toner from the toner bottle T to the developing unit 100 earlier although the amount of discharge of toner of the toner bottle T after the replacement was larger than the target amount.

According to the embodiment, since the accumulated total value ΣΔD of differences is not cumulated in a period after the toner bottle T has been replaced until the accumulated number of times of rotations of the toner bottle T becomes 10 times, the amount of variation of the toner concentration in the developing unit 100 may be restrained. In addition, according to the embodiment, since the accumulated total value ΣΔD of differences is not cumulated in the period after the toner bottle T has been replaced until the accumulating number of times of rotation of the toner bottle T reaches 10 times, the period after the toner bottle T has been replaced until the toner concentration in the developing unit 100 is stabilized at the target value may be reduced. In other words, according to the toner supplement control of the embodiment, even when the toner bottle T has replaced, the amount of toner to be supplemented to the developing unit may be controlled with high degree of accuracy.

The embodiment employs a configuration in which the difference ΔD is not added to the accumulated total value ΣΔD of differences in the period after the toner bottle T has been replaced until the accumulating number of times of rotation of the toner bottle T reaches 10 times. However, a configuration in which the accumulated total value computing section 1202 sets the value of the difference ΔD to 0 and adds the difference ΔD to the accumulated total value ΣΔD of differences in the period described above is also applicable.

The embodiment employs a configuration in which the result of computation of the accumulated total value ΣΔD of differences is memorized in the RAM 502, and the accumulated total value ΣΔD of differences memorized in the RAM 502 is read out when computing the required amount X in the case where the toner bottle T has been rotated by 10 turns or more after the toner bottle T has been replaced. However, a configuration in which the result of computation of the accumulated total value ΣΔD of differences is not memorized in the RAM 502 in the period after the toner bottle T has been replaced until the accumulating number of times of rotation of the toner bottle T reaches 10 times is also applicable.

The embodiment employs a configuration in which the controller 500 executes the toner supplement control process every time when the image forming portion P forms an image in one page of the recording member. However, the timing of execution of the toner supplement control process by the controller 500 is not limited thereto. For example, a configuration in which the toner supplement control process in FIG. 4 is executed by the controller 500 at a predetermined time interval while a stirring screw configured to stir the toner accumulated in the developing unit 100 rotates. In this configuration, the toner may be supplemented from the toner bottle T to the developing unit 100 even at the timing when the image forming portion P does not form the toner image.

The embodiment employs a configuration in which the amount of toner to be supplied from the toner bottle T to the developing unit 100 is controlled by controlling the amount of rotation of the toner bottle T. However, a configuration in which the amount of supply is controlled in accordance with a speed of rotation of the toner bottle T is also applicable. In this configuration, the controller 500 may determine the speed of rotation of the toner bottle T based on the required amount X of toner to be supplemented from the toner bottle T to the developing unit 100 to control the supply motor 120 so that the speed of rotation of the toner bottle T achieves the determined speed of rotation.

According to the invention, even though the container is replaced, the difference between the amount of toner and the target amount of toner in the accumulating unit may be controlled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260381, filed Dec. 17, 2013 which is hereby incorporated by reference herein in its entirety.

What is claimed is:

1. An image forming apparatus comprising:

an image forming unit including an accumulating unit for accumulating developer containing toner and configured to form an image by using the toner in the accumulating unit based on an image data;

a first sensor configured to measure a toner density of the developer in the accumulating unit;

a portion to which a container is mountable, the container containing toner;

a second sensor configured to detect absence or presence of the container at the portion;

a driving unit configured to rotate the container mounted on the portion to supply the toner from the rotating container to the accumulating unit;

a difference computing section configured to determine first information corresponding to a difference between the toner density and a target toner density of the developer in the accumulating unit;

an accumulated value computing section configured to accumulate the difference determined by the difference computing section and determine second information corresponding to an accumulated value of difference; and a controller configured to control the driving unit based on the first information and the second information, and determine whether the container is exchanged with another container based on a detection result by the second sensor, wherein the second information does not change in a period from a timing that the controller determines that the container is exchanged with the other container until the controller performs a predetermined times of supplement from the other container to the accumulating unit.

2. The image forming apparatus according to claim 1 wherein the accumulated value computing section is configured to add the difference as 0 to the accumulated value determined before the controller determines that the container is exchanged with the other container in the period.

3. The image forming apparatus according to claim 1 wherein the driving unit performs a supplementing action by rotating the container by a predetermined amount of rotation, and the period is a period after the other container is mounted on the portion until the accumulated number of times of rotation of the container reaches a predetermined number of times of rotation.

4. The image forming apparatus according to claim 1 further comprising a consumed amount computing section configured to determine third information corresponding to an amount of toner consumed from the accumulating unit by the image forming unit forming the toner image based on the image data, wherein the controller controls the driving unit based on the first information, the second information, and the third information.

5. The image forming apparatus according to claim 4, wherein the controller is configured to determine a control value for controlling the driving unit based on the first information, the second information, and the third information, the controller does not rotate the container unless a value obtained by accumulating the control values exceeds a threshold value.

6. The image forming apparatus according to claim 5 wherein the controller determines an amount of rotation of the container based on the control value, and the driving unit rotates the container based on the determined amount of rotation.

7. The image forming apparatus according to claim 5, wherein the controller determines the control value every time when the image forming unit forms an image for one page of a recording member.

8. The image forming apparatus according to claim 5, wherein the accumulating unit includes a stifling screw configured to stir the developer stored in the accumulating unit, and the controller determines the control value in a predetermined time interval while the stifling screw stirs the developer.

9. The image forming apparatus according to claim 4, wherein the consumed amount computing section determines a video value based on the image data, and refers a conversion table indicating the video value and the amount of toner consumed from the accumulating unit to determine the third information.

10. A method of controlling an image forming apparatus including:

an image forming unit including an accumulating unit for accumulating developer containing toner and configured to form an image by using the toner in the accumulating unit;

a first sensor configured to measure a toner density of the developer in the accumulating unit;

a portion to which a container is mountable, the container containing toner;

a second sensor configured to detect absence or presence of the container at the portion; and a driving unit configured to rotate the container mounted on the portion to supply the toner from the rotating container to the accumulating unit, the method comprising:

determining first information corresponding to a difference between the toner density and a target toner density of the developer in the accumulating unit;

accumulating the difference;

determining second information corresponding to an accumulated value of difference;

controlling the driving unit based on the first information and the second information; and determining whether the container is exchanged with another container based on a detection result by the second sensor, wherein the second information does not change in a period from of the determining that the container is exchanged with the other container until the driving unit performs a predetermined times of supplement from the other container to the accumulating unit.

11. The method according to claim 10, further comprising adding the difference as 0 to the accumulated value determined before the determining that the container is exchanged with the other container in the period.

12. The method according to claim 10, wherein the driving unit performs a supplementing action of one dose of toner by rotating the container attached on the portion by a predetermined amount of rotation, and the period is a period after the other container is mounted on the portion until the accumulated number of times of rotation of the other container reaches a predetermined number of times of rotation.

13. The method according to claim 12, wherein the controlling determines a control value for controlling the supplementing based on the first information and the second information, and the container attached on the portion is not rotated until a value obtained by accumulating the control values exceeds a threshold value.

14. The method according to claim 13, wherein an amount of rotation of the container is determined based on the control value.

15. The method according to claim 10, further comprising determining third information corresponding to an amount of toner consumed from the accumulating unit by the image forming unit forming the toner image based on the image data, wherein the controlling the driving unit is controlled based on the first information, the second information, and the third information.

16. The method according to claim 15, wherein a control value for controlling the driving unit is determined based on the first information, the second information, and the third information, and the controlling the driving unit does not rotate the container until the value obtained by accumulating the control values exceeds a threshold value.

17. The method according to claim 16, wherein the controlling is determined every time when the image forming unit forms an image for one page of a recording member.

18. The method according to claim 16, wherein the accumulating unit includes a stifling screw configured to stir the developer in the accumulating unit, and the control value is determined in a predetermined time interval while the stifling screw stirs the developer in the accumulating unit.

* * * * *